United States Patent [19]

Wohlford et al.

[11] Patent Number: 4,716,401

[45] Date of Patent: Dec. 29, 1987

[54] TAMPER-RESISTANT SUPERVISORY SYSTEM

[75] Inventors: William P. Wohlford, Bettendorf; LaVern B. Hovenga, Davenport, both of Iowa

[73] Assignee: Deere & Company, Moline, Ill.

[21] Appl. No.: 777,647

[22] Filed: Sep. 19, 1985

[51] Int. Cl.[4] ..... G08B 13/14

[52] U.S. Cl. ..... 340/568; 340/666

[58] Field of Search ..... 340/568, 571, 666, 509, 340/511, 693, 652, 658, 661, 521, 506, 686–687

[56] References Cited

U.S. PATENT DOCUMENTS

| | | | |
|---|---|---|---|
| 3,010,100 | 11/1961 | Muehter | 340/509 |
| 3,478,352 | 11/1969 | Eisenberg | 340/664 X |
| 3,500,394 | 3/1970 | Egesdal | 340/652 X |
| 3,553,730 | 1/1971 | Kaplan et al. | 340/512 |
| 3,633,199 | 1/1972 | Curry et al. | 340/571 X |
| 3,641,547 | 2/1972 | Reiss et al. | 340/511 |
| 3,646,552 | 2/1972 | Fuhr | 340/652 X |
| 3,710,372 | 1/1973 | Andersson et al. | 340/568 X |
| 3,740,741 | 6/1973 | Jones | 34/666 |
| 3,786,501 | 1/1974 | Marnerakis | 340/541 X |
| 3,798,628 | 3/1974 | Ive | 340/545 X |
| 3,997,890 | 12/1976 | Kendrick, Jr. | 340/693 X |
| 4,274,088 | 6/1981 | Pierson et al. | 340/568 |
| 4,369,436 | 1/1983 | Lautzenheiser | 340/511 X |
| 4,538,142 | 8/1985 | Hamilton et al. | 340/666 X |

FOREIGN PATENT DOCUMENTS 2248443 4/1974 Fed. Rep. of Germany .

*Primary Examiner*—Glen R. Swann, III
*Assistant Examiner*—Thomas J. Mullen, Jr.

[57] ABSTRACT

A supervisory system includes a plurality of remote sensing units for positioning under the weight of an item to be monitored. The sensor unit includes a resistor connected in parallel with a switch which is held open by the weight of the article, but which will close when the article is removed from the sensor unit. A cable connects each sensor unit to a monitoring circuit which includes a DC potential source, a square wave generator, an impedance network, a comparator circuit and an alarm signal generator. The comparator circuit activates the alarm signal in response to certain changes in the sensor unit or in the cable.

11 Claims, 2 Drawing Figures

TAMPER-RESISTANT SUPERVISORY SYSTEM

BACKGROUND OF THE INVENTION

This invention relates to a supervisory system for monitoring a plurality of remote stations from a central station.

Large merchandise items, including agricultural equipment, industrial machinery and certain consumer products, are stored outdoors for display because it is costly to store such items inside an enclosure. Thus, such products are frequently stolen from dealer lots, shipping yards and farm yards. Alarm systems have been designed to protect such items, but such systems have not been used extensively because of their bulk, expense, ineffectiveness and/or unreliability.

For example, it is known to use remote supervisory circuits coupled to a central station via conductors, such as described in U.S. Pat. No. 3,588,890. However, as is typical of such systems, only a simple DC voltage source, such as a battery, is connected to the remote circuits. In this case, such a supervisory system can be defeated by connecting an equivalent impedance and/or potential source to the conductors and then cutting the connection to the remote circuit. It would be desirable to have an electronic supervisory system which cannot be so easily defeated.

SUMMARY OF THE INVENTION

An object of the present invention is to provide an electronic supervisory system which is difficult to defeat.

A further object of this invention is to provide such a supervisory system which is low in cost, transportable and reliable.

These and other objects are achieved by the present invention which includes a plurality of remote sensing circuits connected to a central monitoring unit via two conductor cables. Each sensor unit includes a resistor connected in parallel with a switch which is normally kept open due to the weight of the monitored article acting upon the sensor assembly which encloses the switch and resistor. The central unit includes a DC potential, such as a battery, and periodic potential source, such as a square wave generator. Both potential sources are coupled via a resistor network to each sensor and to a corresponding pair of comparators. The comparators will generate an alarm signal if the conductors are cut or short-circuited and if the article is removed from the remote sensor unit, thus closing the switch. The system cannot be defeated merely by connecting a simple battery in place of the sensor unit because the voltage across the conductors will normally include a DC component and a periodically varying component. A more sophisticated attempt to defeat the system could involve connecting a more complicated potential source (having both DC and periodically varying components) across the conductors. Even this more sophisticated effort to defeat the system would still most likely fail due to the difficulty of exactly matching the amplitude, frequency and phase characteristics of the periodically varying potential source used in the central unit.

DETAILED DESCRIPTION

Figure 1:
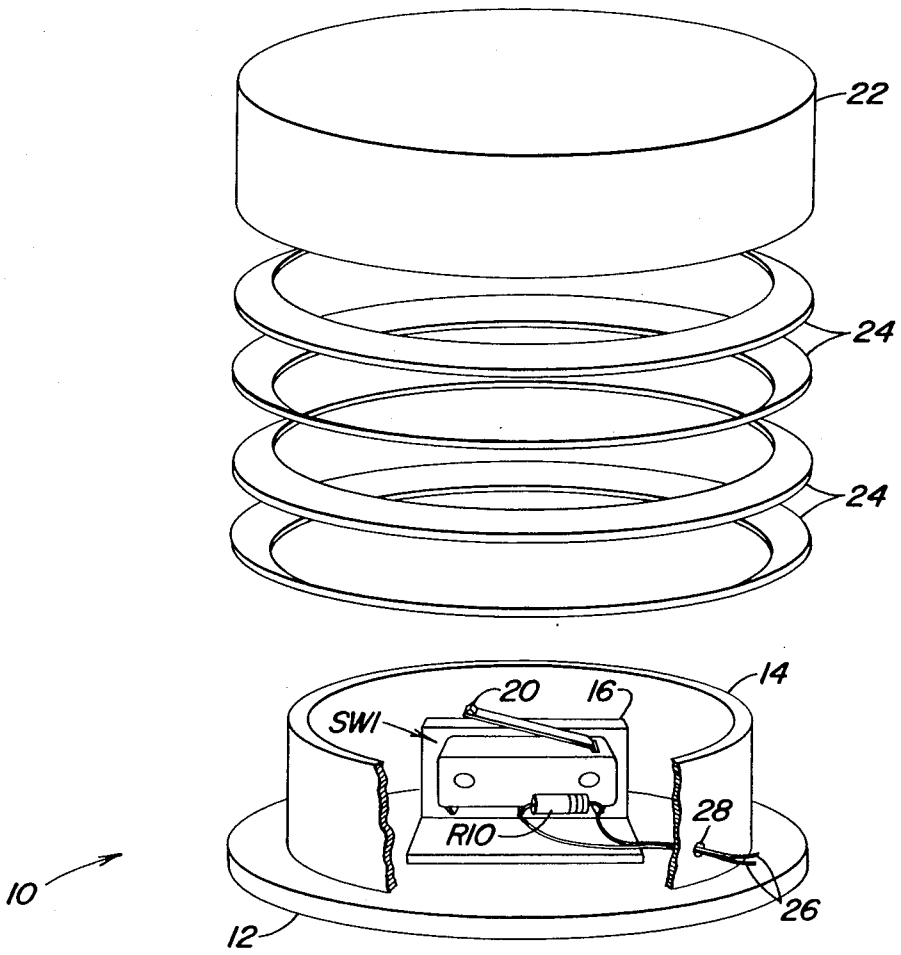
FIG. 1 is an exploded view of a remote sensing unit of the present invention, with portions removed for clarity.

The article security system includes a weight-sensitive article sensor 10, best seen in FIG. 1, which has a rigid discshaped base 12 which supports a rigid section of tubing or pipe 14. An angle bracket 16 is fixed centrally on the base 12. A commercially available snap-action switch SW1 is mounted on the bracket 16 so that its lever 20 projects above the top of the bracket 16. A resistor R10 is connected across (in parallel with) a pair of the contacts of switch SW1. The contacts used are those which are open when the lever 20 is depressed (not shown) closed when the lever 20 is extended (shown). A cylindrical cap 22 is movably fitted over the tube 14 and is supported by a stack of Bellville washers 24 or some other resilient device, such as a spring. The Bellville washers 24 are supported by the top of the tube 14 and are received by the cap 22 when the cap 22 is placed over the tube 14. A pair of conductors 26 connected to SW1 and resistor R10 are routed out of the sensor 10 via an opening 28 in the tube 14.

Figure 2:
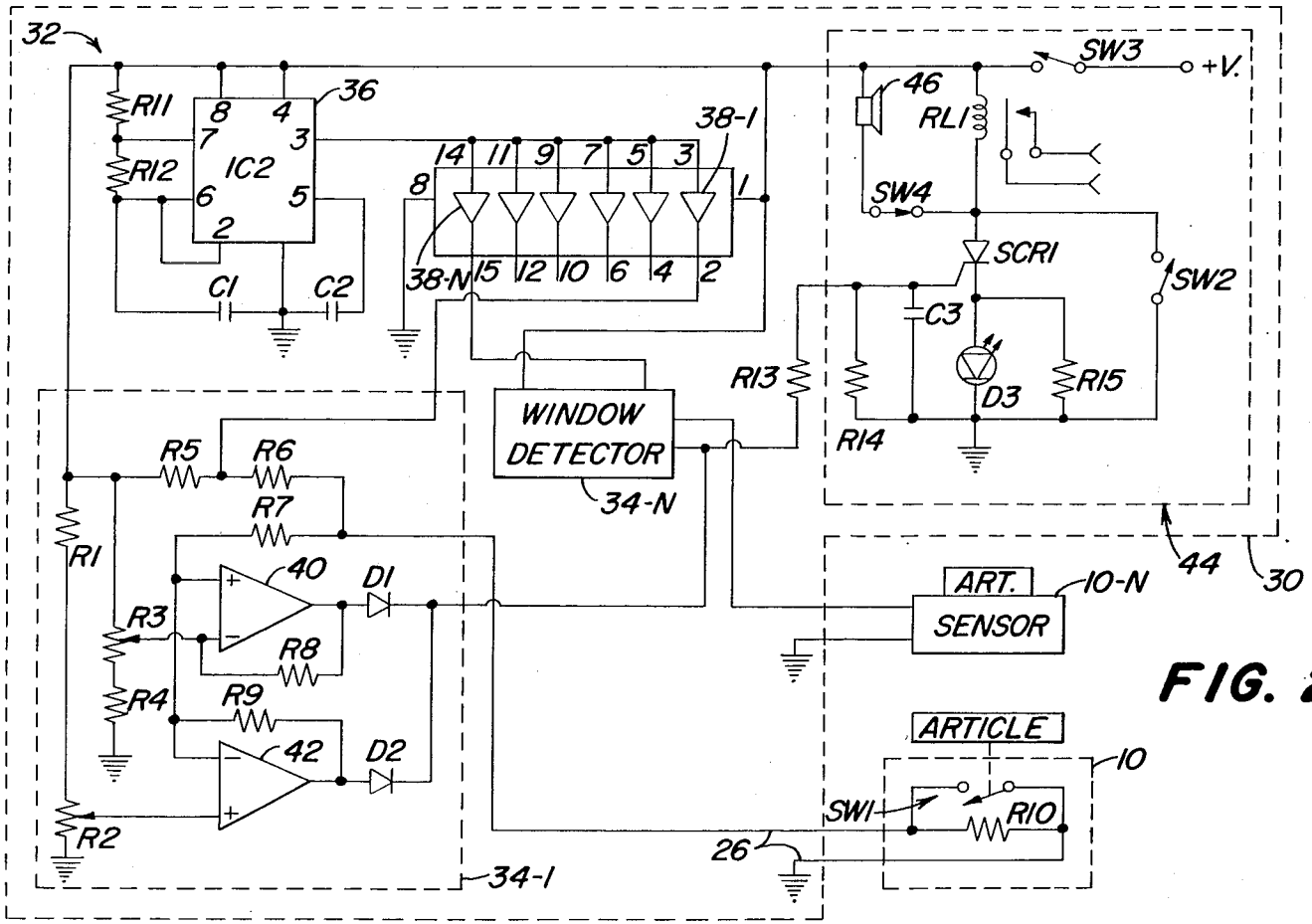
FIG. 2 is an electrical schematic diagram of the central unit of the present invention.

Turning now to FIG. 2, the sensor 10 is connected via conductors 26 to a monitoring circuit 30. Circuit 30 includes a DC potential source +V (9–18 volts) which supplies a DC voltage via switch SW3 to a source of periodically varying potential, such as a square wave generator 32, and to a window detector or comparator circuit 34-1.

The square wave generator 32 includes resistors R11 and R12, capacitors C1 and C2 and a known integrated circuit timer 36, such as a "555" timer. The 100 Hz, 2-volt peak-to-peak output of timer 36 is applied to respective inputs of one or more buffer amplifiers 38-1 to 38-N. Buffer amps, such as a DC4050, are acceptable.

The window detector 34-1 includes an impedance or resistor network which includes three series-connected resistors R5, R6 and R7. Resistor R5 is connected to receive the DC voltage. The common connection between R5 and R6 receives the square wave from buffer amp 38-1 so that at this point, the square wave is superimposed on the DC signal. The common connection between resistors R6 and R7 is connected to one side of switch SW1 and sensor resistor R10 of sensor unit 10. The other side of switch SW1 and resistor R10 is grounded within circuit 30. Resistor R7 is connected to the non-inverting input (+) of a comparator 40 and to the inverting input (−) of a comparator 42. Feedback resistors R8 and R9 are coupled across comparators 40 and 42, respectively. The resistor network also includes a potentiometer R3 with its resistance coupled to the DC voltage and to resistor R5 and with its wiper connected to the inverting input (−) of comparator 40. Potentiometer R3 is coupled to ground via resistor R4. The resistor network also includes a resistor R1 which has one side connected to the DC voltage and to resistor R5 and which has another side connected to ground via a potentiometer R2. The wiper of potentiometer R2 is coupled to the non-inverting input (+) of comparator 42. The outputs of comparators 40 and 42 are tied together via diodes D1 and D2 and connected to alarm circuit 44.

Alarm circuit 44 includes resistors R13, R14 and R15, a capacitor C3, a light emitting diode (LED) D3, a silicon controlled rectifier SCR1 and a reset switch SW2. The SCR1 is connected to the DC voltage +V via a horn or audible alarm device 46 connected in series with a switch SW4. The SCR1 is also connected to the DC potential source via the coil of relay RL1 which may be connected to an additional remote warning device (not shown).

Additional sensors 10-N and window detectors 34-N can be connected, as shown, so that a plurality of articles can be monitored.

MODE OF OPERATION

When an article is placed upon the sensor 10, its weight depresses cap 22 which, in turn, depresses lever 20 and opens SW1. With switch SW1 open, potentiometers R2 and R3 are adjusted so that both comparators 40 and 41 are off, but so that one or the other of them will turn on if there is at least a small voltage change at the (+) input of comparator 40 or at the (−) input of comparator 42. With the resistor network of window detector 34-1, the signals received by sensor 10 and by the inputs of comparators 40 and 42 will have a DC component and an AC or periodic or repetitive signal component, such as a square wave component.

If the article is removed from sensor 10, such as during a theft, the Bellville washers 24 will move cap 22 upwards so that lever 20 extends and switch SW1 closes. This short-circuits resistor R10 and lowers the voltage at the (−) input of comparator 42, thus turning on comparator 42. This turns on SCR1 and energizes LED D3 and horn 46, thus providing an alarm signal indicating the removal of the article from the sensor 10.

If conductors 26 are cut, this will open-circuit the connection from ground to the common connection between R6 and R7. This raises the voltage at the (+) input of comparator 40, turning on comparator 40. This also turns on SCR1 and energizes horn 46 and LED D3.

It is possible that an unauthorized person, such as a thief, could attempt to defeat this security system. Such an attempt could include connecting a power supply across conductors 26 to match the normal measured voltage across conductors 26. With the present invention, such an attempt would most likely fail. This is due to the fact that the 100 Hz square wave voltage is superimposed on the DC signal at the junction between resistors R5 and R6. Thus, in order to defeat this security system, the thief would have to use a power supply which would include a square wave voltage with a matching amplitude, frequency and phase. The difficulty and complexity of such a task makes the present invention an effective security system which cannot easily be defeated.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

We claim:

1. A supervisory system comprising:

a sensor unit including an electrical parameter which varies as a function of presence and absence of an article to be supervised;

a conducting cable;

a monitoring unit connected to the sensor unit via the cable, the monitoring unit comprising:

a first source of potential having a first characteristic;

a second source of potential having a second characteristic which is different from the first characteristic, at least one of the sources producing a periodically varying potential;

an impedance network connected to the first and second potential sources and to the cable, the impedence network producing a status signal having a component with the first characteristic and having a component with the second characteristic, the status signal varying as a function of the electrical parameter of the sensor unit and as a function of the condition of the cable; and means for generating an alarm signal in response to changes in the status signal, the alarm signal generating means comprising a comparator having a first input connected to the impedence network to receive the status signal, having a second input connected to receive a reference signal and having an output, the comparator producing a signal at its output which depends upon signals applied to its inputs.

2. The supervisory system of claim 1, wherein:

the first potential source comprises a DC potential source.

3. The supervisory system of claim 1, wherein:

the second potential source comprises a source of periodically varying potential.

4. The supervisory system of claim 3, wherein:

the second source of potential comprises a square wave generator for producing a square wave signal with a predetermined frequency.

5. The supervisory system of claim 1, wherein the impedance network comprises:

first, second and third series-connected resistors, the first resistor being connected to the first potential source, the second potential source being connected to a common connection between the first and second resistors, the sensor unit being connected to a common connection between the second and third resistors via the cable, and the third resistor being connected between the second resistor and the first comparator input.

6. A supervisiory system for detecting the presence and absence of an article, the system comprising:

a trigger unit having a housing which is deformable under the weight of an article, an electrical impedance, and a switch electrically connected to the impedance and coupled to the housing so that the switch is in a first state when the housing is not deformed and so that the switch is in a second state when the housing is deformed;

a monitoring unit coupled to the trigger unit by a cable, the monitoring unit comprising:

a first source of DC potential;

a second source of periodically varying potential;

an impedence network connected to the first and second potential sources and to the cable, the impedence network cooperating with the first and second potential sources, the cable and the switch to produce a status signal which varies as a function of the state of the switch and the condition of the cable, the status signal having both DC and periodically varying components; and a comparator circuit for generating an alarm signal when the status signal deviates from a predetermined range, the comparator circuit comprising first and second comparators, each comparator having non-inverting and inverting inputs coupled to the impedance network and having an output coupled to an operator-detectable alarm device, at least one input of each comparator receiving the status signal.

7. The alarm system of claim 6, wherein the impedance network comprises:

first, second and third series-connected resistors, the first resistor being connected to the first potential source, the second potential source being connected to a common connection between the first and second resistors, the trigger unit being connected to a common connection between the second and third resistors via the cable, and the third resistor being connected between the second resistor and the non-inverting input of the first comparator and between the second resistor and the inverting input of the second comparator.

8. The alarm system of claim 7, wherein the impedance network further comprises:

a fourth resistor coupled in series with a first potentiometer resistance, the first potentiometer resistance being connected to the first potential source and to the first resistor, the first potentiometer having a wiper connected to the inverting input of the first comparator, the fourth resistor being coupled between the first potentiometer resistance and ground potential; and a fifth resistor coupled in series with a second potentiometer resistance, the fifth resistor being coupled to the first potential source and to the first resistor, the second potentiometer resistance being coupled between the fifth resistor and ground and the second potentiometer having a wiper connected to the non-inverting input of the other second comparator.

9. An article security system comprising:

a weight-sensitive article sensor having electrical means for alternating between a first electrical state when the article is supported by the sensor and a second electrical state when the article is removed therefrom;

a monitoring circuit coupled to the means for alternating by a conductor, the monitoring circuit compising:

a DC signal generator;

a periodically varying signal generator;

means for generating a combined signal derived by superimposing the periodic signal on the DC signal, the combined signal being applied to the article sensor via the conductor; and a window comparator receiving the combined signal and coupled to the electrical means via the conductor, the window comparator generating an alarm signal in response to a change in the state of the means for alternating and in response to a change in the condition of the conductor, the window comparator comprising:

a first comparator having an output, a non-inverting input receiving the combined signal and an inverting input received a first reference signal derived from the DC and periodic signals;

a second comparator having an output, an inverting input receiving the combined signal and having a non-inverting input receiving a second reference signal derived from the DC and periodic signals; and a diode OR circuit having a first input coupled to the output of the first comparator and having a second input coupled to the output of the second comparator.

10. A supervisory system comprising:

a sensor unit including an electrical parameter which varies as a function of presence and absence of an article to be supervised;

a conducting cable;

a monitoring unit connected to the sensor unit via the cable, the monitoring unit comprising:

a first source of potential having a first characteristic;

a second source of potential having a second characteristic which is different from the first characteristic, at least one of the sources producing a periodically varying potential;

an impedance network connected to the fist and second potential sources and to the cable, the impedance network producing a status signal which varies as a function of the electrical parameter of the sensor unit and as a function of the condition of the cable, the impedance network comprising first, second and third series-connected resistors, the first resistor being connected to the first potential source, the second potential source being connected to a common connection between the first and second resistors, the sensor unit being connected to a common connection between the second and third resistors via the cable; and means for generating an alarm signal in response to changes in the status signal, the alarm signal generating means comprising a comparator having a first input connected to the impedance network, having a second input connected to receive a reference signal and having an output, the comparator producing a signal at its output with a characteristic which depends upon signals applied to its inputs, the third resistor being connected between the second resistor and the first comparator input.

11. A supervisory system for detecting the presence and absence of an article, the system comprising:

a trigger unit having a housing which is deformable under the weight of an article, an electrical impedance, and a switch electrically connected to the impedance and coupled to the housing so that the switch is in a first state when the housing is not deformed and so that the switch is in a second state when the housing is deformed;

a monitoring unit coupled to the trigger unit by a cable, the monitoring unit comprising:

a first source of DC potential;

a second source of periodically varying potential;

an impedance network connected to the first and second potential sources and to the cable, the impedance network cooperating with the first and second potential sources, the cable and the switch to produce a status signal which varies as a function of the state of the switch and the condition of the cable, the impedence network comprising first, second and third series-connected resistors, the first resistor being connected to the first potential source, the second potential source being connected to a common connection between the first and second resistors, the trigger unit being connected to a common connection between the second and third resistors via the cable; and a comparator circuit for generating an alarm signal when the status signal deviates from a predetermined range, the comparator circuit comprising first and second comparators, each comparator having non-inverting and inverting inputs coupled to the impedance network and having an output coupled to an operator-detectable alarm device, the third resistor being connected between the second resistors and the non-inverting input of the first comparator and between the second resistor and the inverting input of the second comparator.

* * * * *